US005970627A

United States Patent [19]

Stenz et al.

[11] Patent Number: 5,970,627

[45] Date of Patent: Oct. 26, 1999

[54] ACTIVE WEB STABILIZATION APPARATUS

[75] Inventors: Douglas S. Stenz, Appleton; Paul H. Stibbe, DePere, both of Wis.

[73] Assignee: Thermo Wisconsin, Inc., Kaukauna, Wis.

[21] Appl. No.: 08/988,917

[22] Filed: Dec. 11, 1997

[51] Int. Cl.[6] ..... F26B 9/00

[52] U.S. Cl. ..... 34/633; 34/636; 34/641

[58] Field of Search ..... 34/611, 618, 623, 34/633, 636, 638, 639, 640, 641, 649, 650, 651, 655; 229/7, 91, 97.3, 136.1; 15/345, 309.1, 409

[56] References Cited

U.S. PATENT DOCUMENTS

| | | | |
|---|---|---|---|
| 3,587,177 | 6/1971 | Overly . | |
| 3,650,043 | 3/1972 | Overly et al. | 34/643 |
| 3,705,676 | 12/1972 | Overl et al. | 34/643 X |
| 3,999,696 | 12/1976 | Reba et al. | 226/7 |
| 4,147,287 | 4/1979 | Reba | 226/7 |
| 4,186,860 | 2/1980 | Reba | 226/91 |
| 4,726,502 | 2/1988 | Cryderman | 226/97 |
| 4,779,357 | 10/1988 | Troescher | 34/643 |
| 5,022,166 | 6/1991 | Nguyen et al. | 34/120 |
| 5,370,289 | 12/1994 | Helms | 226/97 |
| 5,466,298 | 11/1995 | Pollock | 134/15 |
| 5,577,294 | 11/1996 | Pollock | 15/345 |

*Primary Examiner*—Henry Bennett
*Assistant Examiner*—Steve Gravini
*Attorney, Agent, or Firm*—Mitchell D. Bittman; Kevin Lemack

[57] ABSTRACT

An active web stabilizer including a structure having a leading edge and a working surface coupled by a curved surface, the working surface being positioned proximate to a passing web. An internal pressurized air duct extends along the working surface orthogonally to the passing web. An air nozzle is provided at the leading edge and is in fluid communication with the air duct, the nozzle directing air flow around the curved surface and along the working surface. The air duct includes first and second chambers separated by a perforated baffle. An extension surface extends from the working surface and includes a trailing end which is angled away from the passing web. A comb is associated with the nozzle to promote web spreading.

47 Claims, 5 Drawing Sheets

ACTIVE WEB STABILIZATION APPARATUS

BACKGROUND OF THE INVENTION

The invention relates to active web stabilization apparatus.

Sheet type products are often manufactured in the form of a continuous web running at high speed between various processing components which may dry, coat or otherwise treat the web. Web support is provided by these components in conjunction with auxiliary rolls. The spaces between support points are known as draws and may, necessarily, be large (many yards). Unsupported in these draws, webs may flutter, billow or otherwise move about with respect to their mean line of travel. Such spurious motion can result in breaks and may otherwise interfere with proper operation of the overall process, particularly in the case of very light weight webs such as tissue and plastic film. The invention relates to non-contact stabilization of such web movement.

U.S. Pat. Nos. 3,587,177 and 3,629,952 describe a drying nozzle and web dryer which provide a means of controlling the travel of a web, without contact, while concurrently drying it. Drying is accomplished by using heated air, but control of the web is achieved by introducing a series of jets as wide as the web, blowing parallel to its path and adjacent to a flat rigid surface.

The action of these jets is to suck the web close to and hold it in proximity to this flat rigid surface. The parallel jets are contrived by means of slot nozzles aimed at an angle to the web, but turned to flow parallel by utilizing the "Coanda effect" along a curved surface. The flow mechanisms at work in this design are elucidated in "Airfoil Web Dryer Performance Characteristics", by Hagen et al., Proceedings of the 1984 TAPPI Coating Conference.

The basic principle that a parallel jet, created using the Coanda effect, can interact with a web has been utilized in a number of web management and related purposes. An example of its use as a web stabilizer is U.S. Pat. No. 3,650,043, and as a web conveyor, U.S. Pat. No. 3,705,676. Web cleaning illustrations are provided in U.S. Pat. Nos. 5,466,298 and 5,577,294. Web threading applications are shown in U.S. Pat. Nos. 3,999,696, 4,147,287, 4,186,860 and 4,726,502.

Web threading applications are only concerned with narrow portions of the web as in a threading tail, and non-contact of the web with the device is not a necessary objective. Web cleaning focuses on high velocity jets for debris removal followed by features which collect and convey the blown air and the entrained dust away from the web for suitable disposal. Local web stabilization, such as for floppy edges, can be achieved with passive devices using the venturi effect working with boundary layer air transported by the web itself as described in U.S. Pat. No. 5,022,166. These devices generally extend in from the web edges for less than a foot.

An attractive means of stabilization applicable to the whole width of the web and acting from one side only to facilitate easy retraction is the passive device of copending U.S. pat. app. Ser. No. 08/685,086. In this case, the stabilizer works on the boundary layer of air carried with the web. It utilizes the streamlined features of an airfoil shape to create the desired parallel stream of air between the stabilizer surface and the web and to divert excess boundary layer air away from the web. It also incorporates special trailing end features to gradually disrupt the suction effect allowing an orderly detachment of the web as it leaves the stabilizer. This device is compact and simple and it is practical to use many of them to stabilize a long web draw.

Since boundary layer thickness is a function of distance travelled from a prior obstruction, the passive stabilizer may be weakly effective when following close to another machine component. These stabilizers can normally accommodate a wrap, without rubbing, only with very low tension webs. Limited web contact is acceptable in some applications. However, as the contact pressure and/or its duration increase, this type of stabilizer may experience wear and may alter the surface characteristics of the web. On tissue machines, such contact may also contribute to dust generation.

Webs, particularly of paper, are not perfectly homogeneous in terms of formation or moisture content. They will frequently have machine direction ripples or local regions where portions of the sheet run somewhat out of the mean plane of motion. This is particularly likely for light weight papers in long draws where the sheet has no cross-machine restraint. When a subsequent roll is encountered, these out of plane regions can gather into permanent wrinkles, thereby impairing the quality of the final product. Bowed rolls are often used to spread the sheet and thereby promote flatness but non-contact devices to accomplish this are needed.

Accordingly, the objective of the invention is to provide a powered non-contact web stabilization apparatus positioned on one side of the web, arranged across the machine up to the entire width of the web, capable of accommodating substantial angles of wrap, locatable without loss of effectiveness immediately following another machine component, applicable in multiple units closely spaced in the machine-direction, and providing a non-contact web spreading function.

SUMMARY OF THE INVENTION

The invention provides a web stabilizer including a cross-machine duct having a working surface positioned proximate to the web path and its longitudinal dimension lying at right angles to the direction of web travel. In its principle embodiment, the cross-section of the web stabilizer is airfoil shaped with its leading edge incorporating a slot nozzle directing airflow around a curved surface and along the under-face of the airfoil, then continuing along an extension of this surface to a perforated trailing end tilted at an angle away from the web path. Internal to the duct are perforated baffles to provide cross-machine flow uniformity. The whole assembly is mounted to the machine frame and provided with a suitable source of pressurized air and connecting ducting.

The high velocity slot jet emitted by the nozzle flows between the stabilizer surface and the web in the same direction as the web travel and at substantially higher velocity. It exerts a more powerful suction effect to draw the web to the stabilizer than can be obtained with passive boundary layer devices. Further, at close proximity, the forced jet can exert greater positive pressure to prevent contact when the web has wrap angle with respect to the stabilizer. Boundary layer air traveling with the web is partially incorporated into the suction stream and the excess passes over the backside of the airfoil cross-section to rejoin the web down stream of the stabilizer.

Web spreading is incorporated using a comb mounted inside the jet assembly which imparts incremental angulation to the airflow with respect to the machine direction. The amount of this angulation and the slot pitch of the comb may be varied with cross-machine position to obtain the desired amount and distribution of spreading action.

In close proximity tandem arrangements of several stabilizers, the trailing ends of all but the last one incorporate a curved end instead of the perforated and tilted terminus used to facilitate web detachment. By this means, some of the air stream is extracted by way of the Coanda effect between succeeding stabilizer units. In applications where this spent air cannot be dissipated locally, it can be collected at the stabilizer with a suitable exhaust manifold, ducted away and disposed of remotely.

For applications where the stabilizer is incorporated closely following another machine element, the airfoil shaped part of the cross-section is not necessary and can be replaced by a modified rectangular, square or other cross-section.

DETAILED DESCRIPTION OF THE ILLUSTRATED EMBODIMENTS

Figure 1:
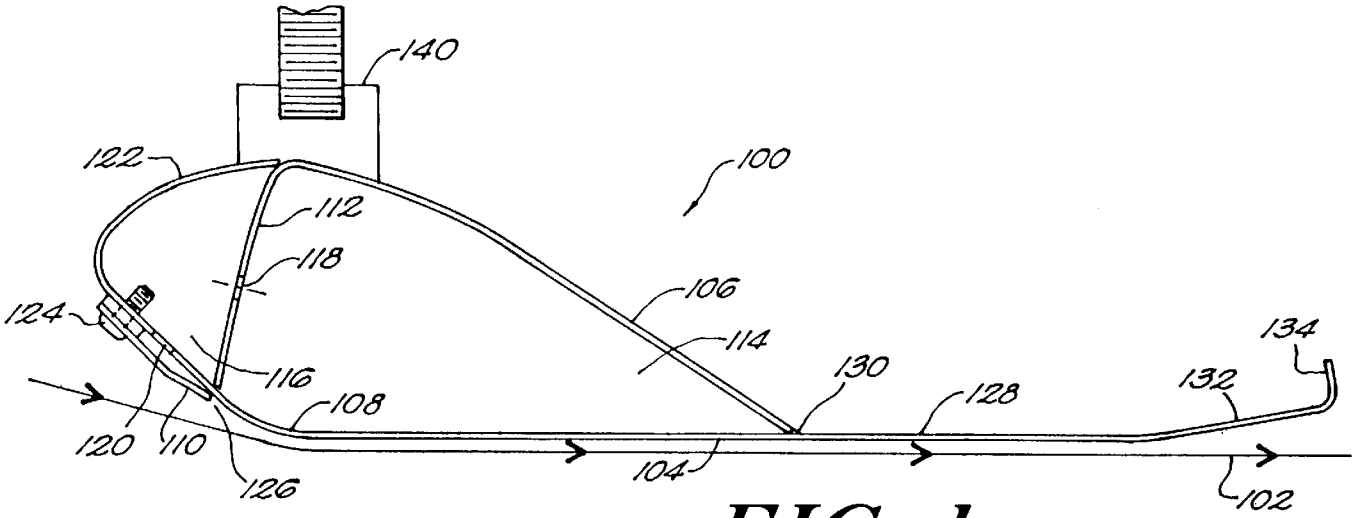
FIG. 1 is a cross-sectional view of an exemplary embodiment of an active airfoil web stabilizer in accordance with the invention.

FIG. 1 is a cross-sectional view of an exemplary embodiment of an active airfoil web stabilizer 100 in accordance with the invention. The web stabilizer 100 is positioned adjacent to a moving web 102 travelling in the direction indicated by the arrow. The airfoil shape is composed of a working surface 104, a curved surface 106, a leading end radius 108 and an adjustable slot nozzle assembly 110.

A cross-machine conduit 114 and associated chamber 116 define an internal duct 115 which is positioned parallel to the web path and its longitudinal dimension lying orthogonal to the direction of web travel. An internal perforated plate or baffle 112 together with curved surface 106 and the working surface 104 bound the cross-machine conduit 114 through which pressurized air is supplied to the chamber 116 via holes 118 in the perforated baffle 112. The baffle provides cross-machine air flow uniformity. In turn, the chamber 116 feeds the nozzle assembly through holes 120 in a forward surface 122 of the airfoil.

The size and spacing of the holes 118 and 120 are tailored to provide the pressure drops needed to obtain uniformity of jet flow using conventional manifold design techniques. Screws 124 allow the slot nozzle portion 110 to be adjusted so as to set the size of a slot orifice 126 to the desired value. Slots are typically in the range of 0.010 to 0.030 inches.

The working surface 104 has an extension. 128 beyond the trailing end of an airfoil portion 130 which terminates in an extension flap 132. The extension flap is positioned at an angle relative to working surface 128. The effective area of this flap is gradually reduced along its length by a series of tapered slots 200 shown in FIG. 2.

Figure 2:
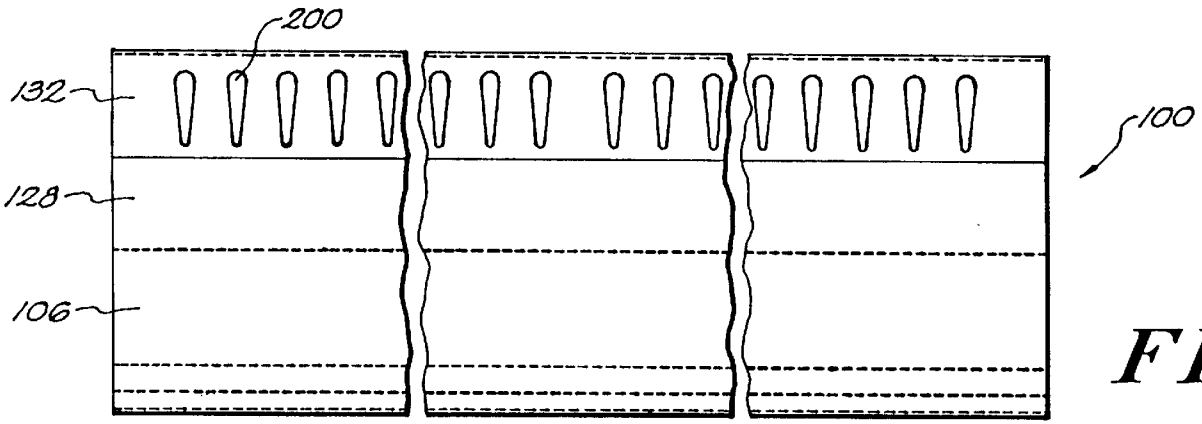
FIG. 2 is a top plan view of the web stabilizer of FIG. 1 illustrating a perforation pattern in the extension flap.

FIG. 2 is a top plan view of the web stabilizer 100 illustrating a perforation pattern of tapered slots 200 in the extension flap 132. Since the flap angle is small, typically less than 15°, the airflow will follow onto the flap 132 without sharply breaking away from the surface. By virtue of the Bernoulli effect, a low pressure is created that will draw air through the tapered slots 200 in the flap surface providing a transition zone for the smooth release of the web from control by the web stabilizer. Under some conditions (low-speed, highly porous webs, etc.), the benefit of the tapered holes may diminish and they could be eliminated.

The trailing edge 134 of the extension flap 132 is formed at approximately 90° relative to the remainder of the flap. This formed section provides substantial mechanical strength and stiffness to the flap. Structure 140 denotes a mechanism by which the stabilizer is mounted at various points across the frame of the machine. The slot nozzle directs airflow around the curved surface by means of the Coanda effect and along the under-face of the airfoil, then continues along the extension of this surface to the perforated trailing end tilted at an angle away from the web path. The whole assembly is mounted to the machine frame and provided with a suitable source of pressurized air and connecting ducting as is known in the art.

The high velocity slot jet emitted by the slot nozzle flows between the stabilizer surface and the web in the same direction as the web travel and at substantially higher velocity. It exerts a more powerful suction effect to draw the web to the stabilizer than can be obtained with passive boundary layer devices. Further, at close proximity, the forced jet can exert greater positive pressure to prevent contact when the web has wrap angle with respect to the stabilizer. Boundary layer air traveling with the web is partially incorporated into the suction stream and the excess passes over the backside of the airfoil cross-section to rejoin the web down stream of the stabilizer.

Figure 3A:
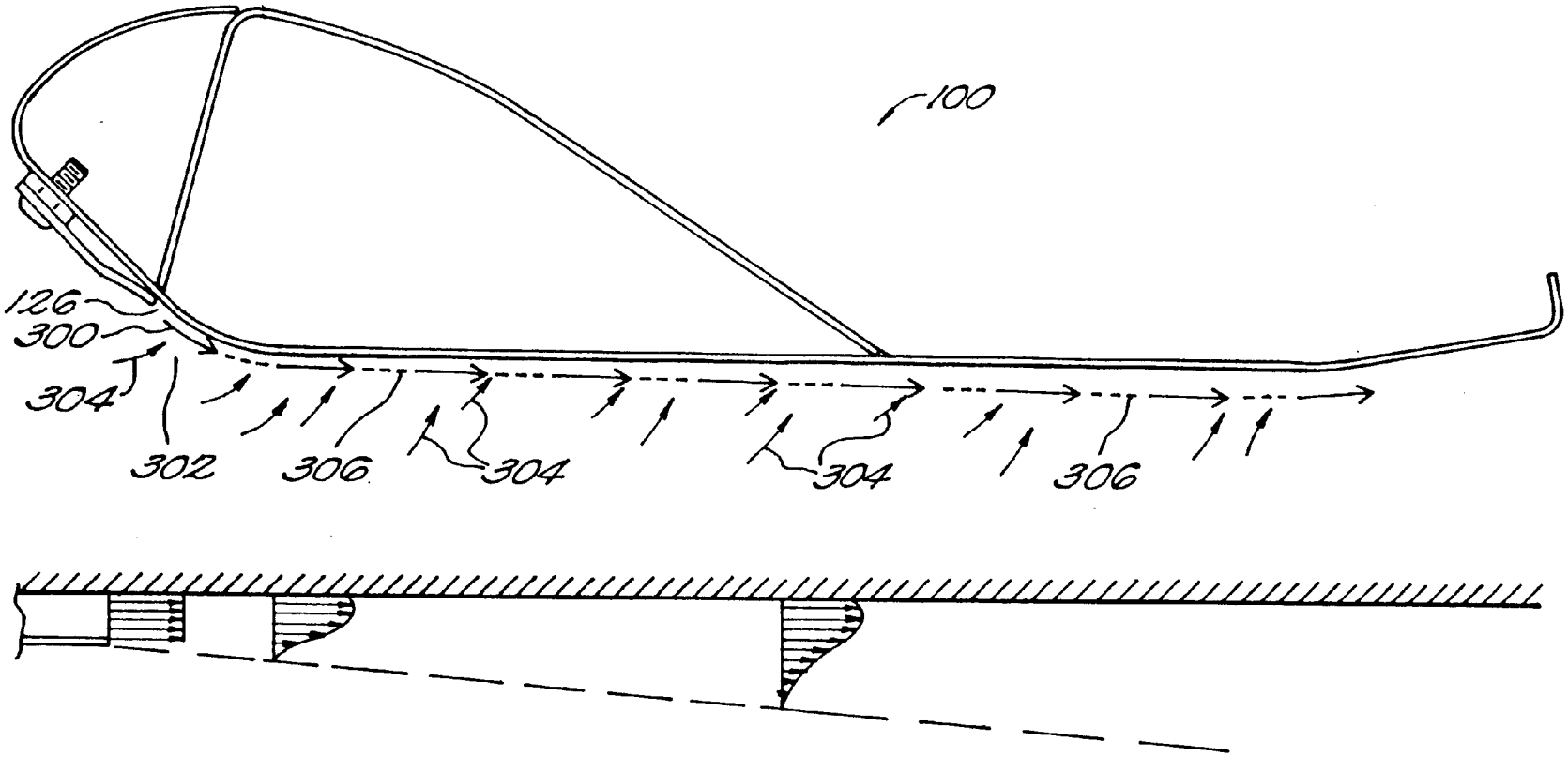
FIGS. 3A and 3B are side view diagrams showing the flow mechanisms of the active web stabilizer of FIG. 1.
Figure 3B:
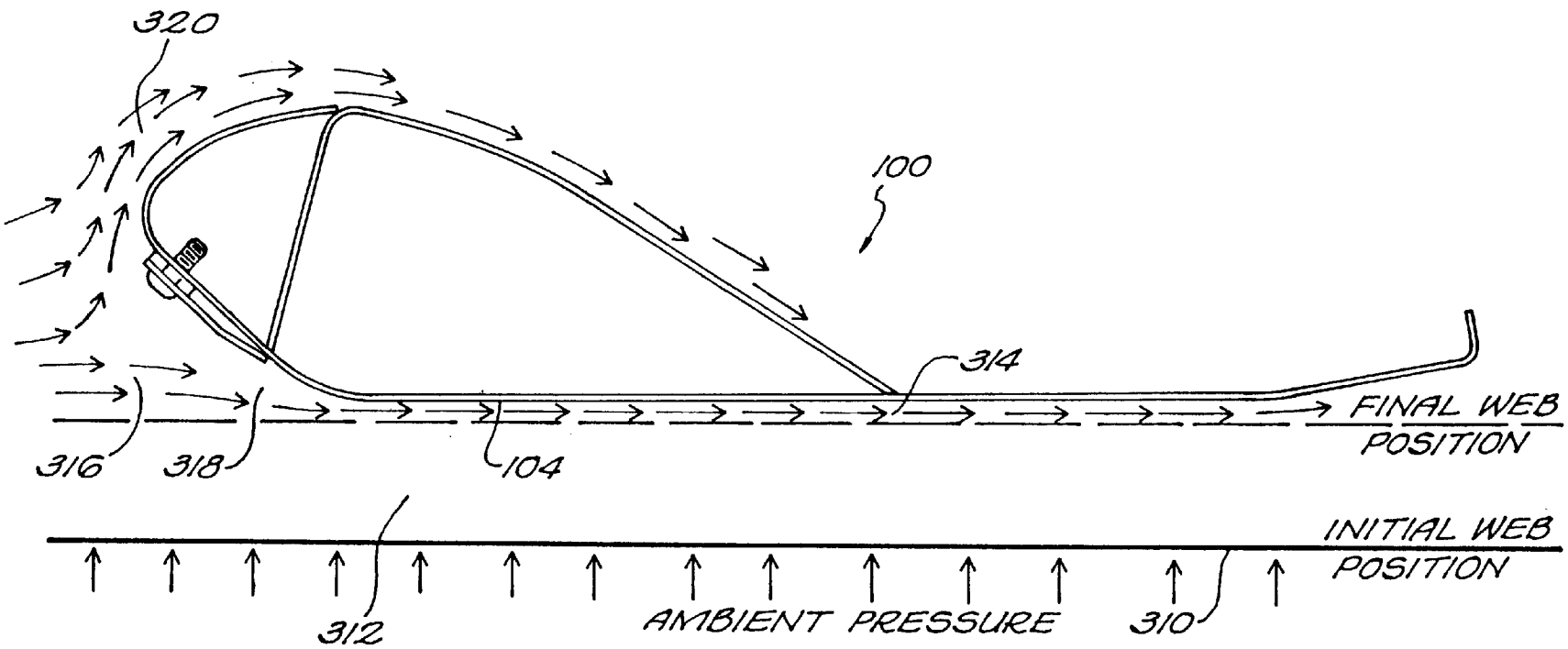

FIGS. 3A and 3B are side view diagrams showing the flow mechanisms of the active web stabilizer 100. In FIG. 3A, a high velocity jet of air 300 emerges from the slot orifice 126. The uniform velocity profile of the air is shown, exaggerated, below the figure. When the jet tries to separate from airfoil surface 302 as the surface curves away from it, the local static pressure drops and the ambient pressure pushes the jet back against the surface. This continues around the entire curve and is the mechanism behind the Coanda effect.

At the outer surface of the jet, local ambient air is entrained and swept away by the jet and air from the general surroundings, then moves in, as at 304, to fill the vacant space.

In this way, the jet grows in thickness, as at 306, as it entrains ambient air and, as seen in the second velocity diagram beneath the figure, the velocity profile develops the typical contour of a wall jet. All along the working surface of the air foil, this action continues with the jet getting increasingly thicker. The energy to accelerate the ambient air comes from the original jet so it does slow down, but a high velocity zone remains near the wall for a considerable distance.

When a movable barrier such as a paper web 310 is brought near to the jet as shown in FIG. 3B, the jet will quickly pump out the air (312) between it and the web. However, the surrounding air is prevented, by the web itself, from moving in to fill the void. Responding to the resulting pressure drop below ambient, the web is pushed toward the surface of the jet. In this case, the jet grows much less by entrainment and retains a more uniform velocity profile. However, friction against the stabilizer surface 104 and the paper web will slow the jet and, to maintain flow continuity, it will get thicker forming a gently divergent flow passage 314.

If the web tries to move further towards the stabilizer surface 104 by encroaching on the jet, static pressure will immediately go positive locally and push it away again. Conversely, if the web tries to move further away, it will create a void and be sucked back. Static experiments show the suction effect to be quite strong and flow stability is maintained at low tension (less than 0.2 pli) for stabilizers at least as long as eighteen inches.

When the web moves co-current with the jet, the stabilizing effect is augmented by a boundary layer 316 travelling with the web. As this air approaches the leading edge of the stabilizer, part of it will accelerate in the convergent passageway 318 between the airfoil and the web producing a drop in static pressure and a corresponding suction effect. The remainder of the boundary layer 320 is diverted around the other side of the stabilizer.

Figures 4A, 4B, 4C:
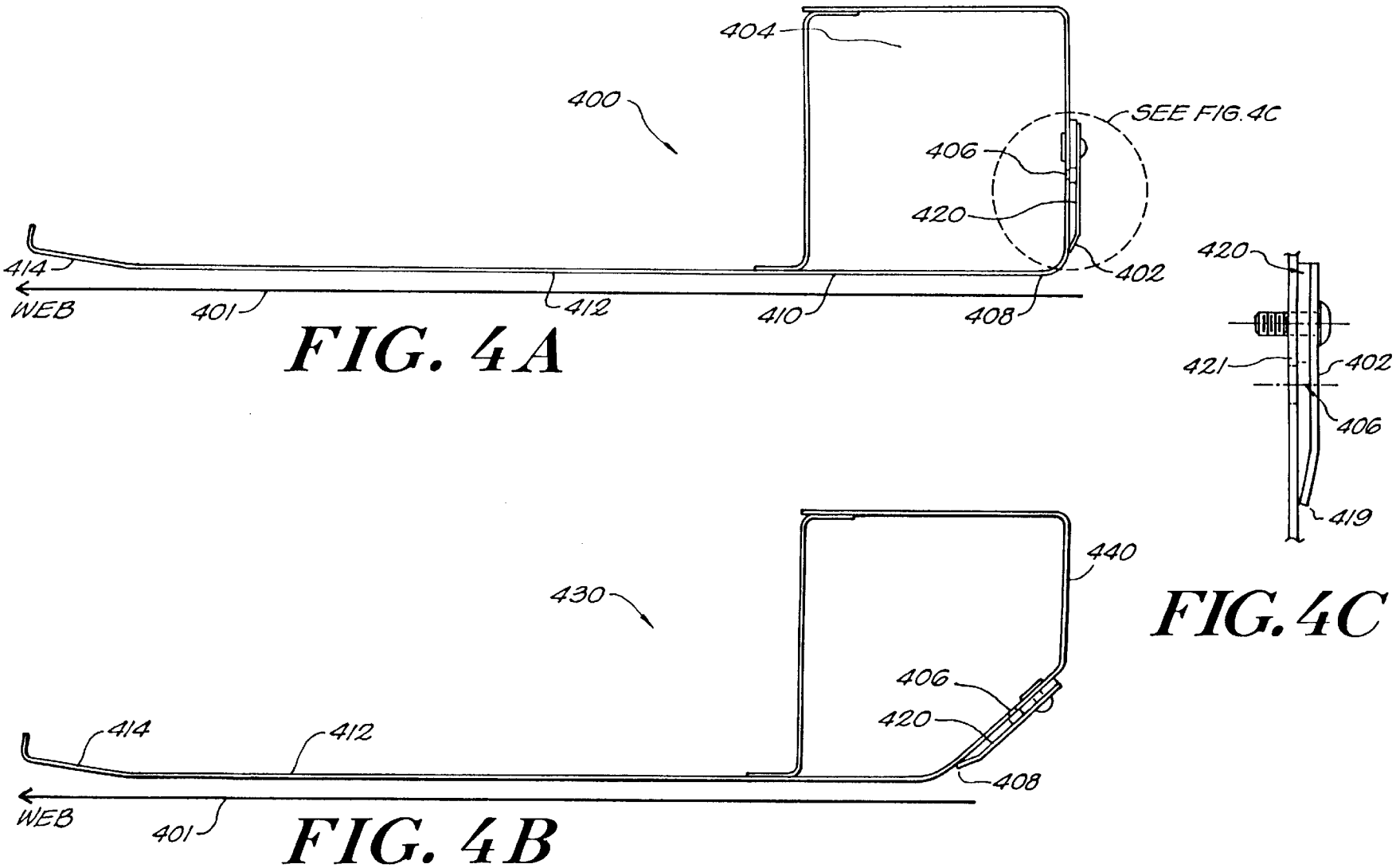
FIG. 4A and 4B are cross-sectional views of alternative embodiments of the invention.
FIG. 4C is an enlarged view of encircled area C of FIG. 4A.

The most critical components of the active web stabilizer 100 shown in FIG. 1 are the slot nozzle itself, the working surface 104 from the jet all the way to the trailing end 130, and the baffle/orifice features, internal to the stabilizer, for insuring uniform jet outflow. The upper airfoil surface can have many differing configurations depending upon the application. For very wide machines, boxier configurations for the cross-machine duct portion are useful for beam strength and for flow distribution purposes. Such configurations are suitable, without streamlining, when the stabilizer closely follows a machine element that has reduced the web boundary layer to a negligible thickness. Examples of such alternatives are shown in FIGS. 4A and 4B. FIGS. 4A and 4B are cross-sectional views of alternative embodiments of the invention.

FIG. 4A shows a stabilizer 400 based on a 5 inch square duct. In this case, a slot nozzle assembly 402 is mounted on the side of the box and is fed from a main chamber 404 by a single series of small orifices 406. The jet traverses a 0.5 inch radius at surface 408 by virtue of the Coanda effect and flows along an active surface 410, an extension surface 412 and the extension flap 416, as in embodiment of FIG. 1.

Web spreading is incorporated using a comb mounted inside the nozzle assembly which imparts incremental angulation to the airflow with respect to the machine direction. The amount of this angulation and the slot pitch of the comb may be varied with cross-machine position to obtain the desired amount and distribution of spreading action.

FIG. 4A also illustrates the web spreading feature shown in the encircled area C and the associated enlarged view of the nozzle assembly in FIG. 4C. A comb 420 is located in the nozzle assembly 402. The comb is divided into angled chambers 422, each receiving supply air from one of the orifices 406. The comb 420 is shown in more detail with reference to FIGS. 5A–5C. The chambers start at the edge of the holes 421 and extend through the convergent part of the nozzle to the exit 419. For reasons of manufacturing economy, the combs could extend only to the beginning of the convergent portion of the nozzle. However, experiment has shown that the spreading effect is severely attenuated as it flows unrestrained through the convergent region. Thus, the preferred embodiment of the spreading comb feature is to extend the angled chambers right to the nozzle exit.

Figure 5A:
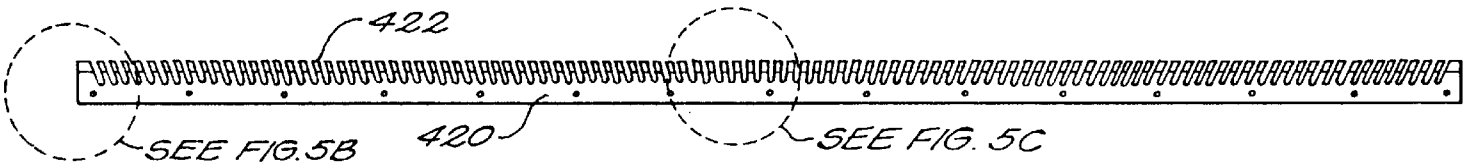
FIG. 5A is a side view of the configuration of a spreading comb.
Figure 5C:
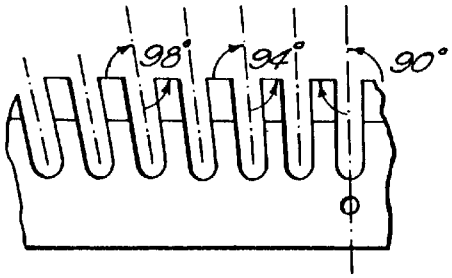
FIGS. 5B and 5C are enlarged views of encircled areas B and C of FIG. 5A.
Figure 5B:
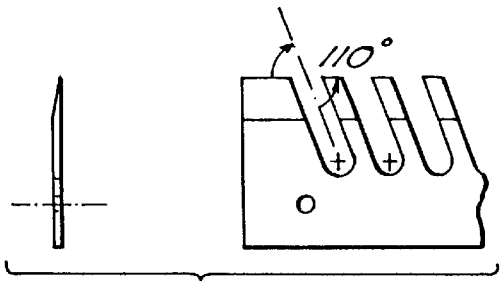

With reference to FIG. 5A, the illustrated embodiment has slots which angle progressively from the mid-region of the web to the edges. Details of the angulation and pitch of the comb slots will vary with the specific amount and profile of spreading desired. FIGS. 5B and 5C are enlarged views of portions of the comb encircled as areas B and C, respectively, of FIG. 5A.

When a web 401 makes a wrap, there is a simple relationship between tension and wrap radius to the pressure needed to balance the tension forces. The relationship is such that pressure=tension/radius. Thus, for a tension of 0.5 pli and a wrap radius of one inch, the required support pressure is 0.5 psi or about 14 ins w.g. This corresponds to the stagnation pressure for a flow velocity of 15,000 fpm. At a tension level of 0.2 pli, the support pressure would be about 5.5 ins w.g. and the corresponding velocity would be 9,500 fpm. Since this support pressure must be provided by a portion of the jet velocity pressure if contact is to be avoided, even these low tension levels demand wrap radii of 1½–3 inches in order to keep jet velocities at reasonable levels.

FIG. 4B illustrates one possible modification of this type of configuration to allow for a larger Coanda radius to handle a web wrap. In this example, maintaining an uncluttered end face 440 of a web stabilizer 430 has been chosen as a secondary objective.

Figure 6:
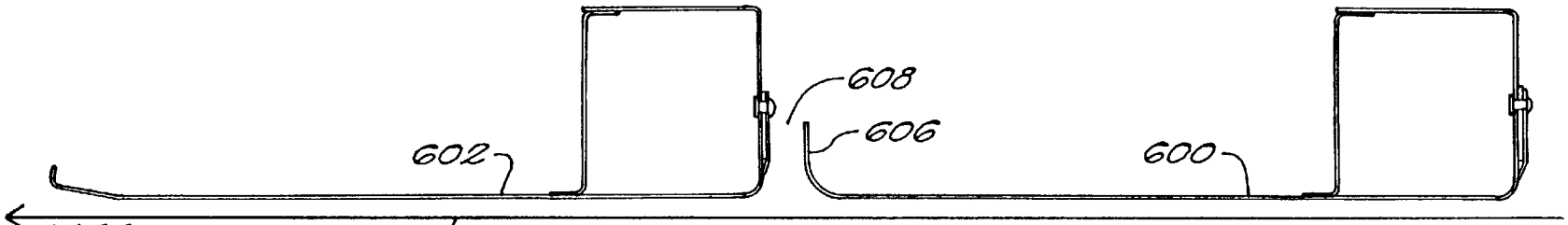
FIG. 6 is a side view of web stabilizers of the invention operating in tandem.

When two of these active stabilizers are used in tandem and at close proximity, the treatment of the trailing end of the upstream stabilizer(s) needs to be different from the stand alone unit. FIG. 6 is a side view of web stabilizers 600, 602 of the invention operating in tandem with a passing web 604. Both stabilizers shown are of the type described with reference to FIG. 4A, the downstream stabilizer 602 being identical to the upstream stabilizer 600.

The upstream stabilizer 600 terminates with the active surface turning away from the web by an angle of about 90° on a radius of about one inch as at 606. This radius encourages part of the flow from the upstream stabilizer to be extracted from the web path with the remainder continuing on and being entrained by the slot nozzle from the downstream stabilizer. Without this alternate trailing end treatment, the flow leaving the upstream unit may swamp the primary flow from the downstream one and disable its ability to generate the negative pressure needed to attract the web. Spent air leaving through exhaust passage 608 can dissipate into the surroundings or be collected and ducted away depending on the particular needs of a given installation.

Velocities from the slot nozzles will generally need to be substantially higher than the web speed. Values in the range of 12,000 to 27,000 fpm are typical. In tandem arrangements, each unit may have a different velocity depending on the needs of the specific application. Velocities should be high enough to achieve satisfactory web stabilization for the particular web type, weight, speed and tension. Web spreading effectiveness will be favored by high velocities.

The foregoing description has been set forth to illustrate the invention and is not intended to be limiting. Since modifications of the described embodiments incorporating the spirit and substance of the invention may occur to persons skilled in the art, the scope of the invention should be limited solely with reference to the appended claims and equivalents thereof.

What is claimed is:

1. An active web stabilizer comprising;

a structure having a leading edge and a working surface coupled by a curved surface, said working surface being positioned proximate to a passing web;

an internal pressurized air duct extending along said working surface orthogonally to said passing web, said air duct including first and second chambers separated by a perforated baffle; and an air nozzle provided at said leading edge and in fluid communication with said air duct, said nozzle directing air flow around said curved surface and along said working surface.

2. The web stabilizer of claim 1, wherein said air nozzle comprises a slot nozzle.

3. The web stabilizer of claim 2, wherein said slot nozzle generates a high velocity air jet between said working surface and said passing web in the direction of web travel.

4. The web stabilizer of claim 3, wherein said air jet comprises a higher velocity than said passing web.

5. The web stabilizer of claim 4, wherein said air jet generates a suction effect to draw said passing web towards said working surface.

6. The web stabilizer of claim 5, wherein said jet air generates a positive pressure to prevent contact with said passing web.

7. The web stabilizer of claim 1 further comprising an extension surface extending from said working surface.

8. The web stabilizer of claim 7, wherein said extension surface comprises a trailing end which is angled away from said passing web.

9. The web stabilizer of claim 8, wherein said trailing end is perforated.

10. The web stabilizer of claim 8, wherein said trailing end comprises an end portion which is angled approximately 90° with respect to said trailing end.

11. The web stabilizer of claim 2 further comprising a comb associated with said slot nozzle to promote web spreading.

12. The web stabilizer of claim 11, wherein said comb imparts incremental angulation to the flow of air.

13. The web stabilizer of claim 12 further comprising means to vary the angulation and slot pitch of said comb.

14. The web stabilizer of claim 1, wherein said structure comprises an airfoil.

15. The web stabilizer of claim 7, wherein said extension surface comprises a second curved surface which curves away from said passing web.

16. The web stabilizer of claim 15 further comprising means for extracting portions of said air jet between said trailing end and a tandemly arranged downstream web stabilizer.

17. An active web stabilizer comprising:

a structure having a leading edge and a working surface coupled by a curved surface, and an extension surface extending from said working surface in the direction of travel of a passing web, said working surface being positioned proximate to said passing web, said extension surface including a trailing end which is angled away from said passing web;

an internal pressurized air duct extending along said working surface orthogonally to said passing web; and an air nozzle provided at said leading edge and in fluid communication with said air duct, said nozzle directing air flow around said curved surface and along said working surface.

18. The web stabilizer of claim 17, wherein said air nozzle comprises a slot nozzle.

19. The web stabilizer of claim 18, wherein said slot nozzle generates a high velocity air jet between said working surface and said passing web in the direction of web travel.

20. The web stabilizer of claim 19, wherein said air jet comprises a higher velocity than said passing web.

21. The web stabilizer of claim 20, wherein said air jet generates a suction effect to draw said passing web towards said working surface.

22. The web stabilizer of claim 21, wherein said jet air generates a positive pressure to prevent contact with said passing web.

23. The web stabilizer of claim 17, wherein said air duct comprises first and second chambers separated by a perforated baffle.

24. The web stabilizer of claim 17, wherein said trailing end is perforated.

25. The web stabilizer of claim 17, wherein said trailing end comprises an end portion which is angled approximately 90° with respect to said trailing end.

26. The web stabilizer of claim 18 further comprising a comb associated with said slot nozzle to promote web spreading.

27. The web stabilizer of claim 26, wherein said comb imparts incremental angulation to the flow of air.

28. The web stabilizer of claim 27 further comprising means to vary the angulation and slot pitch of said comb.

29. The web stabilizer of claim 17, wherein said structure comprises an airfoil.

30. The web stabilizer of claim 17, wherein said extension surface comprises a second curved surface which curves away from said passing web.

31. The web stabilizer of claim 30 further comprising means for extracting portions of said air jet between said trailing end and a tandemly arranged downstream web stabilizer.

32. An active web stabilizer comprising:

a structure having a leading edge and a working surface coupled by a curved surface, said working surface being positioned proximate to a passing web;

an internal pressurized air duct extending along said working surface orthogonally to said passing web;

an air nozzle provided at said leading edge and in fluid communication with said air duct, said nozzle directing air flow around said curved surface and along said working surface; and a comb associated with said nozzle to promote web spreading, said comb comprising a plurality of chambers.

33. The web stabilizer of claim 32, wherein said air nozzle comprises a slot nozzle.

34. The web stabilizer of claim 33, wherein said slot nozzle generates a high velocity air jet between said working surface and said passing web in the direction of web travel.

35. The web stabilizer of claim 34, wherein said air jet comprises a higher velocity than said passing web.

36. The web stabilizer of claim 35, wherein said air jet generates a suction effect to draw said passing web towards said working surface.

37. The web stabilizer of claim 36, wherein said jet air generates a positive pressure to prevent contact with said passing web.

38. The web stabilizer of claim 32 further comprising an extension surface extending from said working surface.

39. The web stabilizer of claim 38, wherein said extension surface comprises a trailing end which is angled away from said passing web.

40. The web stabilizer of claim 39, wherein said trailing end is perforated.

41. The web stabilizer of claim 39, wherein said trailing end comprises an end portion which is angled approximately 90° with respect to said trailing end.

42. The web stabilizer of claim 32, wherein said air duct comprises first and second chambers separated by a perforated baffle.

43. The web stabilizer of claim 32, wherein said comb imparts incremental angulation to the flow of air.

44. The web stabilizer of claim 43 further comprising means to vary the angulation and slot pitch of said comb.

45. The web stabilizer of claim 32, wherein said structure comprises an airfoil.

46. The web stabilizer of claim 38, wherein said extension surface comprises a second curved surface which curves away from said passing web.

47. The web stabilizer of claim 46 further comprising means for extracting portions of said air jet between said trailing end and a tandemly arranged downstream web stabilizer.

* * * * *